US008281981B2

(12) United States Patent
Foden

(10) Patent No.: US 8,281,981 B2
(45) Date of Patent: Oct. 9, 2012

(54) SHIPPING AND DISPLAY CONTAINER

(75) Inventor: Roy D. P. Foden, Denton (GB)

(73) Assignee: International Paper Company, Memphis, TN (US)

( * ) Notice: Subject to any disclaimer, the term of this patent is extended or adjusted under 35 U.S.C. 154(b) by 803 days.

(21) Appl. No.: 11/827,161

(22) Filed: Jul. 11, 2007

(65) Prior Publication Data

US 2009/0014352 A1 Jan. 15, 2009

(51) Int. Cl.
*B65D 79/00* (2006.01)
*B65D 5/02* (2006.01)

(52) U.S. Cl. ..... 229/126; 206/746

(58) Field of Classification Search ..... 206/746, 206/736; 229/126, 240, 125.41, 120.011
See application file for complete search history.

(56) References Cited

U.S. PATENT DOCUMENTS 3,917,158 A * 11/1975 Dorofachuk et al. ..... 229/241
4,058,206 A * 11/1977 Morse et al. ..... 229/241
6,510,982 B2 * 1/2003 White et al. ..... 229/235
6,598,785 B2 7/2003 Quaintance
6,749,107 B2 6/2004 Quaintance
6,981,632 B2 1/2006 Gardner et al.
2005/0184139 A1 8/2005 Gasior

* cited by examiner

*Primary Examiner* — Nathan J Newhouse
*Assistant Examiner* — Christopher Demeree
(74) *Attorney, Agent, or Firm* — Matthew M. Eslami

(57) ABSTRACT

A container and a blank for making it. The container is constructed from a single sheet of foldable material and has a bottom wall, a top wall, first and second front wall panels, a back wall, and side flaps extending from opposite ends of the bottom, top, and back walls, and from the first and second front wall panels. The top wall is secured to the container by a tear-out panel extending from the top wall into the back wall and by frangible side flap portions in the side walls, whereby the tear-out panel may be grasped and lifted to lift the top wall and break the frangible side flap portions, completely freeing the top wall from the container by the single step of grasping and tearing out and lifting the tear-out panel to pivot the top upwardly. A blank and method of assembling and erecting the blank to form the container also are disclosed.

9 Claims, 9 Drawing Sheets

SHIPPING AND DISPLAY CONTAINER

FIELD OF INVENTION

This invention relates generally to containers and to blanks for making them. More specifically, the invention relates to a corrugated shipping and display container and to a blank for making it, wherein the container is easy to open and provides easy access to the contents when it is open.

BACKGROUND OF THE INVENTION

Many products are shipped in containers having a portion that can be removed at a point of use or sale to display the product in the container and make the product easily accessible. These containers typically have a top portion that can be partially or wholly removed or pivoted out of the way to expose the contents. Containers with removable top portions generally use tear tapes or the like to facilitate the separation of the top portion from the bottom portion. Such structure is difficult to manufacture and burdensome to use. Further, containers with limited removable sections restrict access to the products within the container. Thus, the nature and type of product that may be placed in the container is limited.

U.S. Pat. No. 6,981,632 is an example of a prior art effort to solve the problems inherent with conventional shipping and display containers as described above. In this patent a blank is folded and glued so that the container can be opened without requiring the use of tear tape or similar means. This is accomplished by gluing together flaps at the sides of the container, with a frangible line connecting a side flap on a top section of the container with a side flap on a bottom section. The frangible line can be broken by grasping and pulling the side flaps connected to the top portion, thereby releasing the top portion side flaps from the bottom portion side flaps and enabling the top portion to be pivoted up to expose the contents of the container. However, the top portion remains attached to the bottom portion along a hinge line at the top of the rear wall. To completely remove the top portion from the bottom portion this hinge line must also be broken. Moreover, the manner of folding and gluing the blank results in a triple thickness of flaps at the sides of the container, and produces interrupted surfaces on the sides of the container that make it difficult to apply graphics to those surfaces.

It would be desirable to have a shipping and display container that has a top portion removably joined to a bottom portion so that the top portion can be completely separated and removed from the bottom portion by the simple expedient of grasping and lifting a tear-out panel in one wall of the container, and wherein uninterrupted flat surfaces are provided on all sides of the container for accepting graphics.

SUMMARY OF THE INVENTION

The present invention comprises a relatively easy opening shipping and display container and a blank for making it, wherein the container has a bottom wall, a top wall, a front wall, and a back wall, each having side flaps at opposite ends folded inwardly to define opposite side walls. First frangible means secures the top wall to the back wall, and second frangible means secures the top wall to the side walls, said first and second frangible means comprising the only means securing the top wall to the container, whereby the first frangible means may be grasped and lifted to lift the top wall and break the second frangible means, completely freeing the top wall from the container by the single step of grasping and tearing out and lifting the first frangible means to pivot the top upwardly.

In a preferred embodiment the front wall is formed of a first front wall panel integral with the top wall and a second front wall panel integral with the bottom wall, said first and second front wall panels each having a side flap extending into said side wall and being secured together only by attachment of said side flaps with side flaps on the top and bottom walls, respectively. The first frangible means comprises a tear-out panel integral with the top wall and extending from a rear edge of the top wall and into the back wall. In a preferred embodiment the tear-out panel has a width less than the width of the top wall where the tear-out panel joins it, leaving short connecting portions at opposite sides of the tear-out panel between the rear edge of the top wall and the top edge of the back wall. A third frangible means extends across each connecting portion so that upon removal of the tear-out panel and breaking of the third frangible means the top wall can be completely separated from the back wall. It should be understood that where the tear-out panel joins the top wall it could have a width substantially the same as the width of the top wall, or it could have substantially less width, as desired. The second frangible means comprises a line of perforations connecting together the side flaps on the first and second front wall panels, wherein the top, part of the back and most of the front of the container can be quickly and easily completely removed by the single step of grasping and tearing out the tear-out panel and lifting the tear-out panel to pivot the top upwardly, breaking the lines of perforations in the side walls that connect the first and second front wall panels together. Further, the manner of folding and gluing the panels in the container of the invention produces uninterrupted flat surfaces on all sides for accepting graphics.

More specifically, the container of the invention comprises a bottom wall, a top wall, a front wall, a back wall, and opposite side walls, wherein the front wall comprises a major front wall panel and a minor front wall panel unsecured to one another, and the side walls comprise secured together side flaps extending from the top wall, front wall, bottom wall and back wall. The side flaps include first side flaps extending from respective opposite ends of the top wall, folded and secured to a respective adjacent first portion of a second side flap extending from opposite ends of the major front wall panel, but unsecured to third side flaps extending from opposite ends of the back wall. Fourth side flaps extending from opposite ends of the bottom wall are folded and secured to the third side flaps extending from opposite ends of the back wall and to fifth side flaps extending from opposite ends of the minor front wall panel. The second side flaps include a second portion lying behind the fourth side flaps. In one embodiment this second portion is secured directly to the fourth side flap, and in another embodiment this second portion lies behind and is secured to the fifth side flap, which is, in turn, secured to the fourth side flap. The first and second portions of the second side flap are joined together by a frangible line so that they may be readily separated from one another. A tear-out panel extends from the top wall into the back wall and may be grasped and pulled away from the back wall to detach it from the back wall and then lifted upwardly and rearwardly to detach the first and second portions of the second side flaps, completely freeing the top wall and the first front wall portion from attachment to said container, whereby the entire top portion of the container may be lifted away from the container to expose product held in the container.

The invention also comprises a single unitary blank of a paperboard material as for example a corrugated material that is cut and scored so that it can be folded to form a container having the features described above. The blank is creased along parallel spaced apart fold lines to define a top wall panel, a bottom wall panel, and a back wall panel extending consecutively along the length of the blank, with major and minor front wall panels at opposite ends of the blank, and pairs of side flaps extending from opposite ends of the top, bottom, back and front wall panels. A part of the side flaps extending from opposite ends of the major front wall panel is cut away to define a first side flap portion and a substantially narrower second side flap portion, with the two portions joined along a frangible line. In one form of the invention the side flaps extending from opposite ends of the minor front panel have approximately the same size and shape as the second side flap portion extending from the major front wall panel so that they overlap in a container erected from the blank, and in another embodiment the side flaps extending from opposite ends of the minor front panel have a portion cut away so that in a container erected from the blank they do not overlap with the second side flap portion extending from the major front wall panel. In a preferred embodiment the major front wall panel has a height from its folded connection with the top panel to its free edge that is substantially the same as the height of the back wall panel from its folded connection with the top wall panel to its free edge, and the minor front wall panel has a substantially smaller height.

More specifically, the blank comprises a single blank of material cut and scored to form bottom, back, and top wall panels extending consecutively along the length of the blank, and major and minor front wall panels at opposite ends of the blank, respectively. The major front wall panel has a height from its connection with the top wall panel to its free edge substantially the same as the height of the back wall panel, and the minor front wall panel has a substantially smaller height. A first pair of side flaps is foldably joined to opposite ends of the top wall panel, a second pair of side flaps is foldably joined to opposite ends of the major front wall panel, a third pair of side flaps is foldably joined to opposite ends of the back wall panel, a fourth pair of side flaps is foldably joined to opposite ends of the bottom wall panel, and a fifth pair of side flaps is foldably joined to opposite ends of the minor front wall panel. Cuts separate the side flaps from adjacent side flaps, and cut-outs are made in the free edges of the side flaps and first and second front wall panels. The cuts and cut-outs are shaped and positioned so that the second pair of side flaps extending from opposite ends of the major front wall panel have a first portion in general alignment with the major front wall panel and a second, narrower portion projecting laterally from the outer free edge of the first portion. A frangible line extends across the juncture of the first and second portions so that they may be separated from one another. In a preferred embodiment these frangible lines each comprise a series of spaced perforations. Generally V-shaped cut-outs are positioned at the ends of the frangible lines to facilitate initiation of tearing of the frangible lines. A tear-out panel is formed in the back wall panel by a pair of frangible lines extending from a thumb tab at about the middle of the back wall panel to adjacent opposite ends of the back wall panel at its juncture with the top wall panel, whereby the top wall panel is connected to the back wall panel only by the frangible lines. In a preferred embodiment these frangible lines are formed by use of a Zipper Rule, which produces a line of spaced perforations. Further, the cut-outs in the free edges of the various panels are shaped and positioned in some embodiments so that in a container erected from the blank there are no more than two thicknesses of overlapped side flaps.

It should be understood that while the frangible means have been described as lines of spaced perforations and/or lines of alternating cuts and creases, other frangible means known in the art could be used. The important point is that these are weakened areas that can be readily separated when desired.

BRIEF DESCRIPTION OF THE DRAWINGS

The foregoing, as well as other objects and advantages of the invention, will become apparent from the following detailed description when taken in conjunction with the accompanying drawings, wherein like reference characters designate like parts throughout the several views, and wherein.

DETAIL DESCRIPTION OF THE PREFERRED EMBODIMENTS

Figure 1:
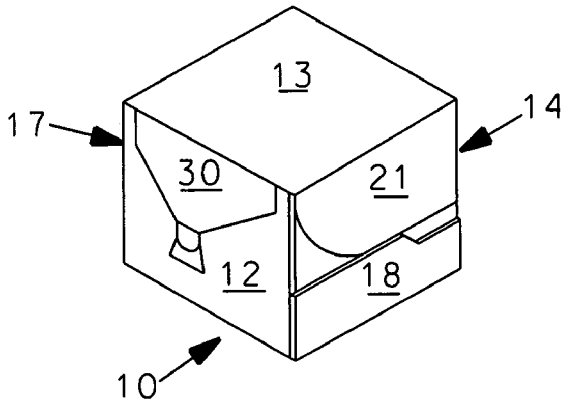
FIG. 1 is a rear top perspective view of a container according to the present invention.

A container according to the present invention is indicated generally at 10 in FIGS. 1-4. The container has a bottom wall 11, back wall 12, top wall 13, a front wall 14 comprising a major front wall panel 15 and minor front wall panel 16, and opposite side walls 17 and 18. The embodiment shown in these figures corresponds to the embodiment shown in FIGS. 7 and 8, wherein major front wall panel is on the outside of the minor front wall panel, but FIGS. 1-4 depict the principles of operation of the invention, which is essentially the same in all embodiments. As seen in these figures, a substantial top portion 19, including the top wall 13, parts of the back wall 12 and side walls 17 and 18 and a majority of the front wall 14, is completely removed from the container to expose the contents for access and/or display in the remaining bottom portion 20.

The major front wall panel 15 and minor front wall panel 16 overlap at adjacent edges (see, e.g., FIGS. 5*a*-5*g*) but are unsecured to one another, and the side walls 17 and 18 comprise secured together side flaps extending from the top wall, front wall and back wall. The side flaps include first side flaps 21 extending from respective opposite ends of the top wall 13, folded and secured by adhesive or other suitable means to a respective adjacent first portion 22*a* of second side flaps 22 extending from opposite ends of the major front wall panel 15, but unsecured to third side flaps 23 extending from opposite ends of the back wall 12. Fourth side flaps 24 extending from opposite ends of the bottom wall 11 are folded and secured to the third side flaps 23 extending from opposite ends of the back wall and to fifth side flaps 25 extending from opposite ends of the minor front wall panel 16. The second side flaps 22 extending from opposite ends of the major front wall panel 15 include a second portion 22*b* that lies behind the fourth side flaps 24. In the embodiment shown in FIGS. 1-4 this second portion is secured directly to the fourth side flap. The first and second portions 22*a* and 22*b* of the second side flap are joined together by a frangible line 26 so that they may be readily separated from one another. In a preferred embodiment these frangible lines each comprise a 3×3 series of spaced perforations.

Figure 2:
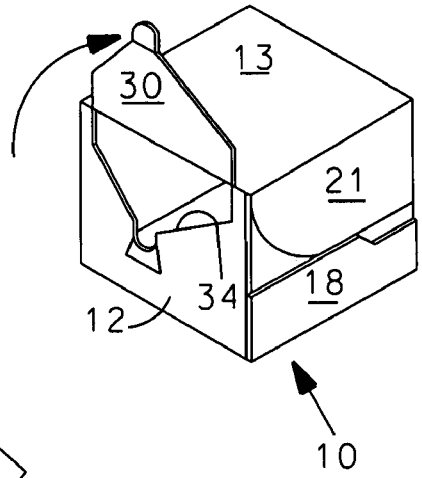
FIG. 2 is a rear top perspective view of the container of FIG. 1, showing the tear-out panel being separated from the rear wall of the container.
Figure 3:
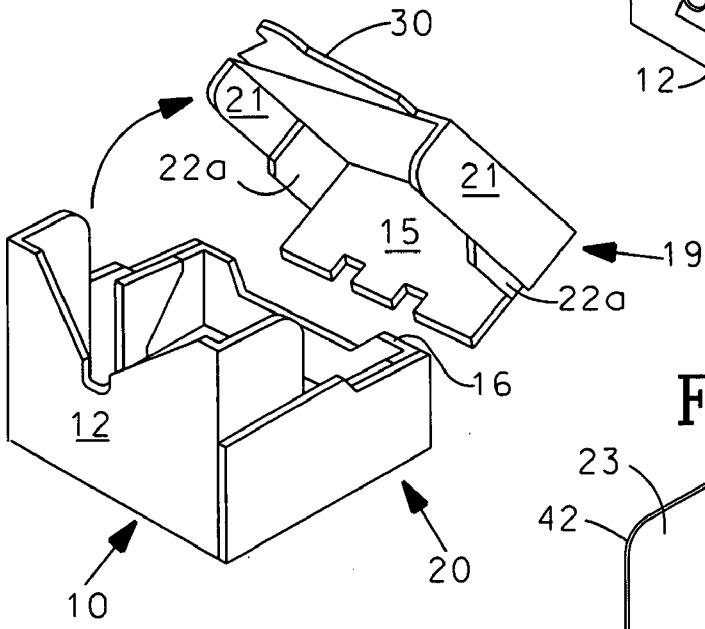
FIG. 3 is a rear top perspective view of the container of FIG. 2, showing the top portion of the container removed according to the invention.
Figure 4:
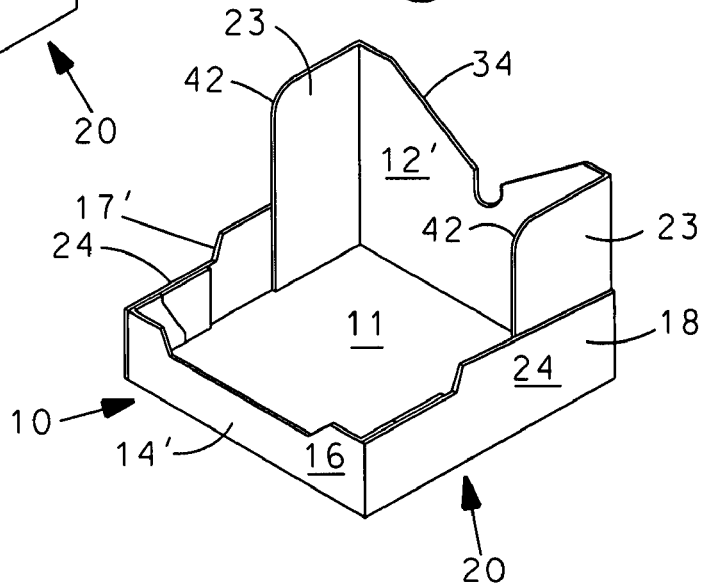
FIG. 4 is a front top perspective view of the container of FIG. 3, with the container turned around to show the front wall.

A tear-out panel 30 in the back wall 12 is defined by diagonal perforated lines 31 and 32 extending from the top wall 13 near its opposite side edges into the back wall and terminating at a thumb tab 33 at approximately the middle of the back wall. This tab may be grasped and pulled away from the back wall to detach the tear-out panel from the back wall. It will be noted that the width of the tear-out panel where it joins the top wall is less than the width of the top wall, leaving short connecting portions X and Y at opposite sides of the tear-out panel. These connecting portions are made frangible at the juncture of the top and back walls by a 3×3 series of alternating cuts and creases. By lifting the tear-out panel upwardly and rearwardly the connecting portions X and Y are broken and the first and second portions of the second side flaps are detached from one another, as shown in FIGS. 2 and 3, and since there is no other attachment between the top portion 19 and bottom portion 20 of the container, the top portion is completely freed from attachment to the container, whereby the entire top portion of the container may be lifted away from the container to expose product held in the container. The remaining bottom portion 20 has a low front wall 14', defined by the minor front wall panel 16, relatively low stepped side walls 17' and 18' defined by the bottom flaps 24 and back wall flaps 23, and a back wall 12' with a removed area 34 where the tear-out panel 30 was removed.

Figure 5:
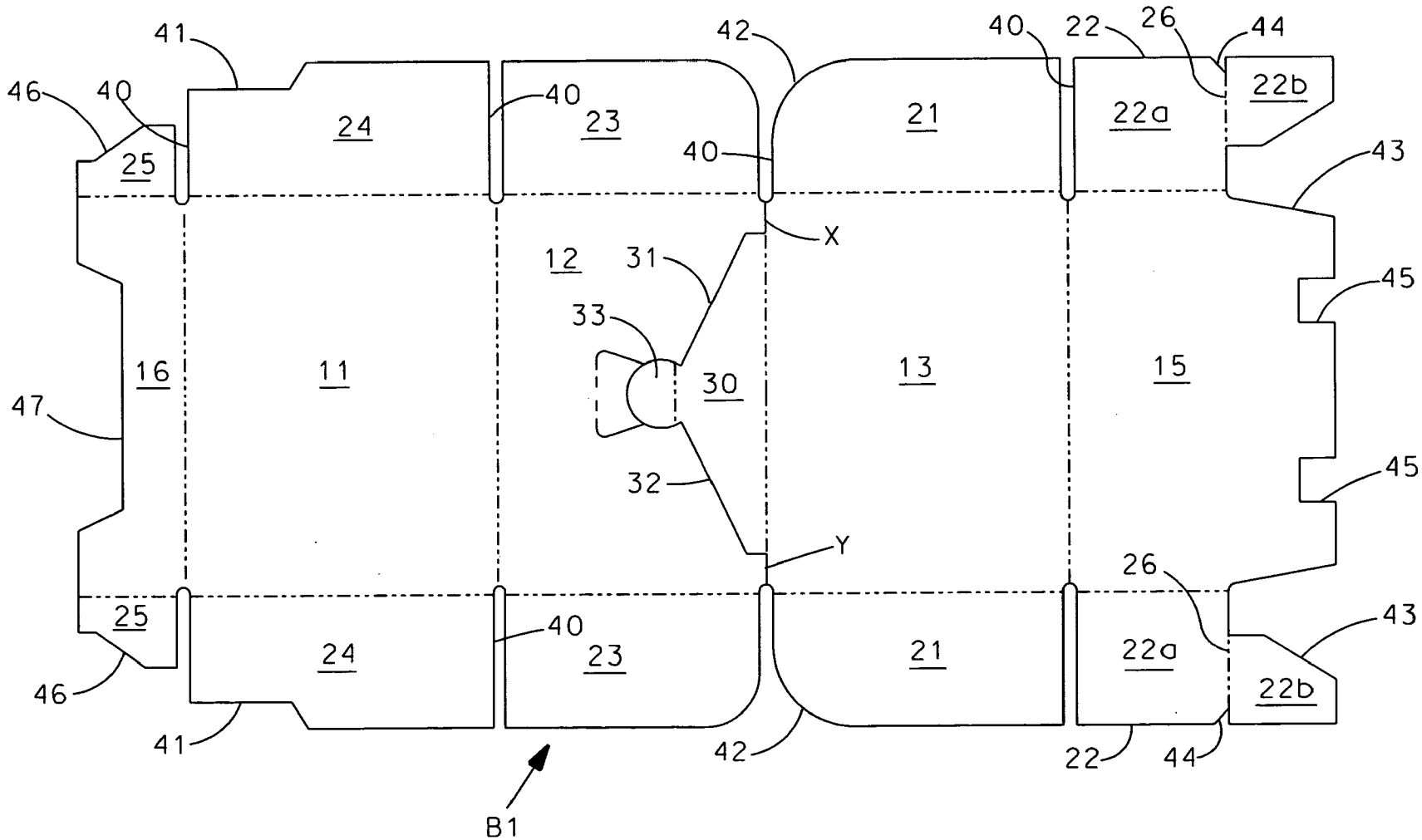
FIG. 5 is a top plan view of a blank for making a first embodiment of container according to the invention, as shown in FIG. 14, for example.

A blank B1 is illustrated in FIG. 5 for making a first embodiment of container having an outside major front wall panel, as shown for example in FIGS. 1-4. The blank comprises a single piece of corrugated material cut and scored to form bottom, back, and top wall panels 11, 12, and 13, respectively, extending consecutively along the length of the blank, and major and minor front wall panels 15 and 16, respectively, at opposite ends of the blank. The major front wall panel 15 has a height from its connection with the top wall panel 13 to its free edge substantially the same as the height of the back wall panel 12, and the minor front wall panel has a substantially smaller height.

A first pair of side flaps 21 is foldably joined to opposite ends of the top wall panel, a second pair of side flaps 22 is foldably joined to opposite ends of the major front wall panel, a third pair of side flaps 23 is foldably joined to opposite ends of the back wall panel, a fourth pair of side flaps 24 is foldably joined to opposite ends of the bottom wall panel, and a fifth pair of side flaps 25 is foldably joined to opposite ends of the minor front wall panel. Cuts or relief slots 40 separate adjacent side flaps from one another. Foldably joined means attached by way of foldlines or for example, a crease, cut line, score line, or the like.

A portion of the outer free edge of the fourth side flaps 24 extending from the bottom panel 11 is cut down to define a relieved area 41 adjacent the minor front wall panel 16, and the corner of the first side flaps 21 adjacent the back wall panel is cut away and rounded at 42.

The outer free edge of the major front wall panel and contiguous edges of the second side flaps extending from the major front wall panel have cut-outs 43 that are shaped and positioned so that the second side flaps 22 have a first portion 22*a* in general alignment with the major front wall panel and a second, narrower portion 22*b* projecting laterally from the outer free edge of the first portion. The frangible line 26 extends across the juncture of the first and second portions so that they may be separated from one another. In a preferred embodiment these frangible lines comprise a 3×3 series of spaced perforations. Generally V-shaped cut-outs 44 are positioned at the ends of the frangible lines to facilitate initiation of tearing of the frangible lines, and machine indexing cuts 45 are made in the outer free edge of the major front wall panel.

The tear-out panel 30 is formed in the back wall panel by the pair of frangible lines 31 and 32 extending from a thumb tab 33 at about the middle of the back wall panel to adjacent opposite ends of the back wall panel at its juncture with the top wall panel, whereby the top wall panel is connected to the back wall panel only by the frangible lines. In a preferred embodiment these frangible lines are formed by use of a Zipper Rule, which produces a line of spaced perforations.

The outer free edges of the fifth side flaps 25 extending from opposite ends of the minor front wall panel 16 are cut away at 46 so that the fifth side flaps have a shape and size generally complemental to the shape and size of the second portions 22*b* on the second side flaps, and a central portion of the outer free edge of the fifth side flaps is cut down at 47.

Figure 5C:
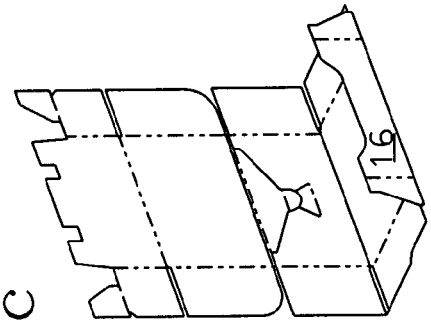
FIGS. 5*a*-5*g* are rear perspective end views showing the steps in assembling and erecting the container of the invention according to the first embodiment, wherein the major front panel is on the outside of the minor front panel.
Figure 5B:
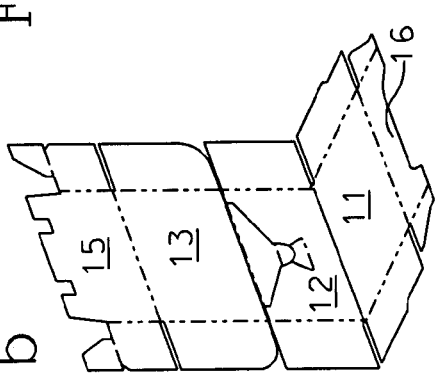
Figure 5A:
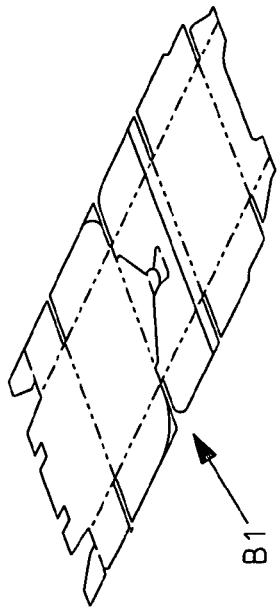
Figure 5G:
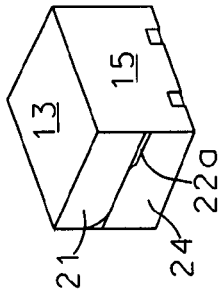
Figure 5F:
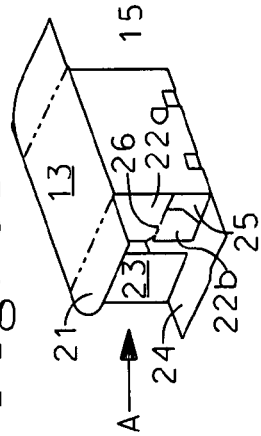
Figure 5E:
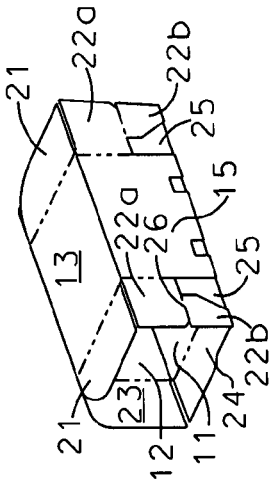
Figure 5D:
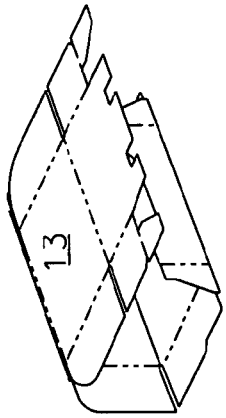
Figure 5H:
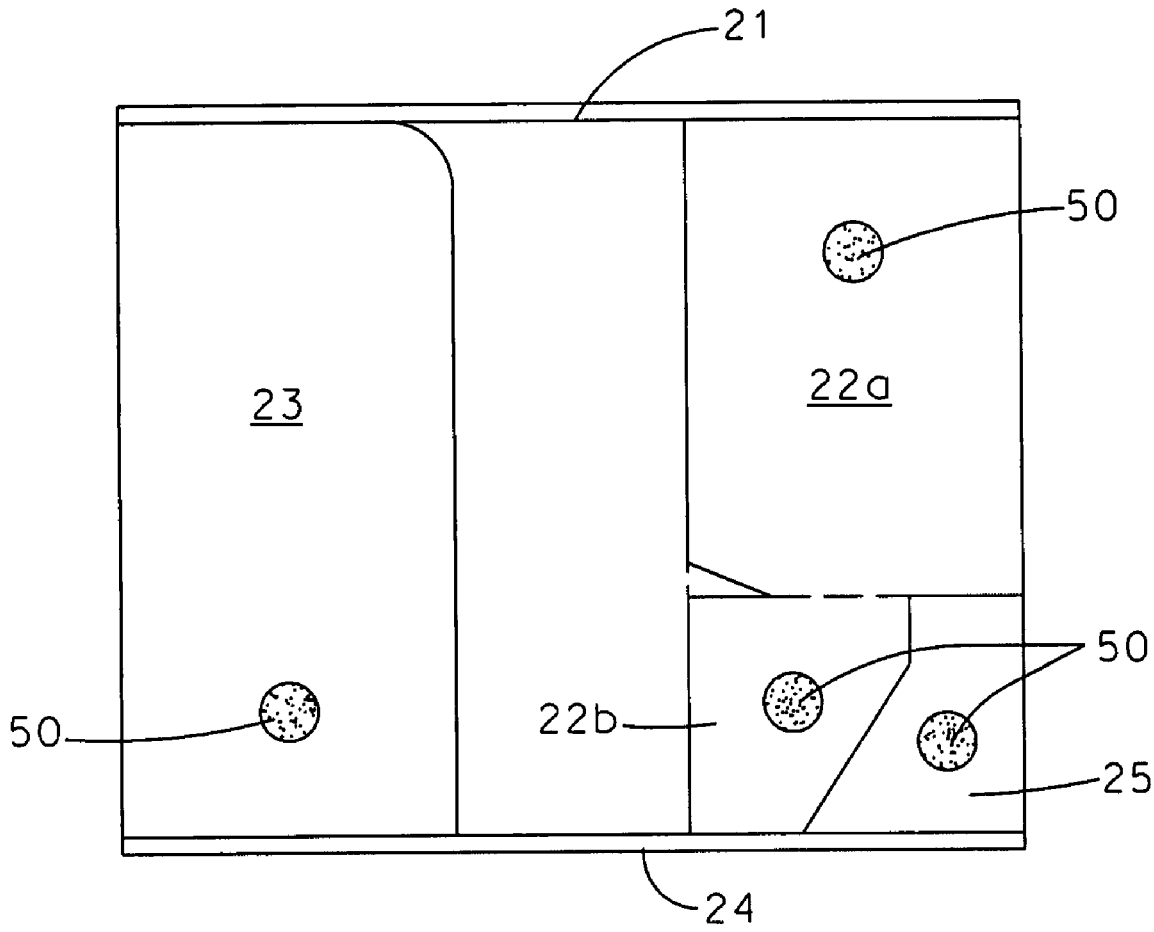
FIG. 5*h* is an end view of the container of FIG. 5 during its assembly, looking in the direction of arrow A in FIG. 5*f;*

As shown in FIGS. 5*a*-5*g*, the blank B1 is first folded between the back panel 12 and bottom panel 11 (FIG. 5*b*), and the minor front wall panel 16 is folded upwardly (FIG. 5*c*). The blank is then folded between the back wall panel and the top wall panel 13 (FIG. 5*d*), after which the major front wall panel 15 is folded downwardly into overlapping relationship with the minor front wall panel 16 (FIG. 5*e*). The side flaps 23 connected to the back wall panel, the side flaps 22 (22*a* and 22*b*) connected to the major front wall panel, and the side flaps 25 connected to the minor front wall panel are next folded inwardly (FIG. 5*f*). As seen best in FIG. 5*h*, hot melt adhesive 50 or other suitable means is applied to a lower portion of the side flaps 23 joined to the back wall panel and to the side flaps 25 on the minor front wall panel and the first portion 22*a* of the side flaps 22 on the major front wall panel. The side flaps 21 and 24 joined to the top and bottom wall panels, respectively, are then folded inwardly (FIG. 5*g*), securing these flaps to the back wall flaps 23 and to the flaps 25 on the minor front wall panel and the first portion 22*a* of the flaps 22 on the major front wall panel. These points of attachment, plus the frangible lines, hold the container in its erected condition.

Figure 6:
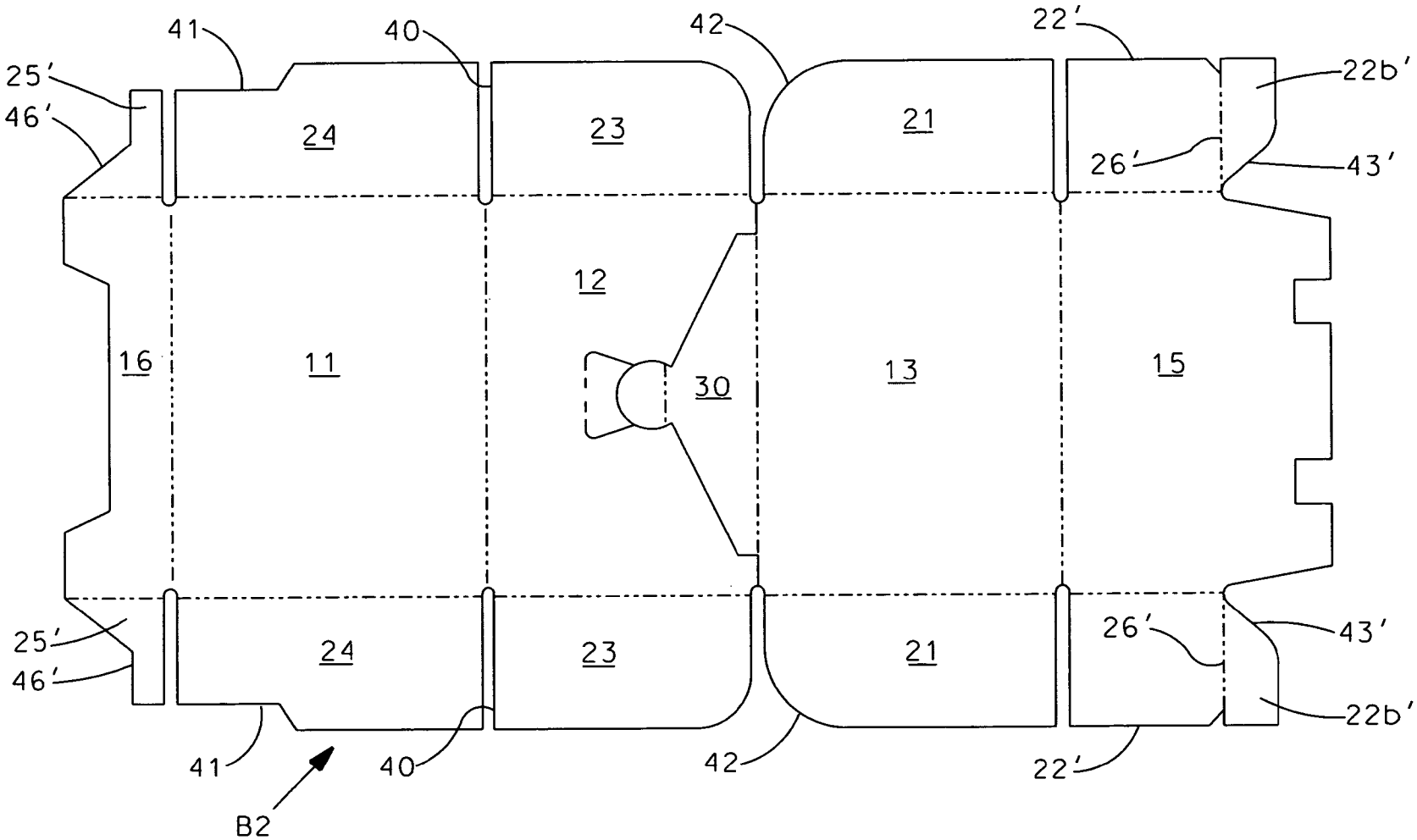
FIG. 6 is a top plan view of a blank for making a second embodiment of container according to the present invention, wherein this embodiment is a variation of the embodiment shown in FIG. 5 and is erected similarly, with the major front wall panel on the outside of the minor front wall panel.

A blank B2 for making a second embodiment of container according to the invention is illustrated in FIG. 6. This form of the invention is substantially the same as the first embodiment, except that the cut outs 43' are smaller and shaped differently than the cuts 43 in the first embodiment, whereby the second portions 22*b*' of the second side flaps 22' are sized and shaped differently and the frangible line 26' is longer than the line 26 in the first embodiment. The cuts 46' in the outer free edges of the fifth side flaps 25' are shaped differently so that these side flaps are shaped differently than the side flaps 25 in the first embodiment. Otherwise, the structure and function and method of assembly and erection of this second embodiment are essentially the same as the first embodiment.

Figure 7:
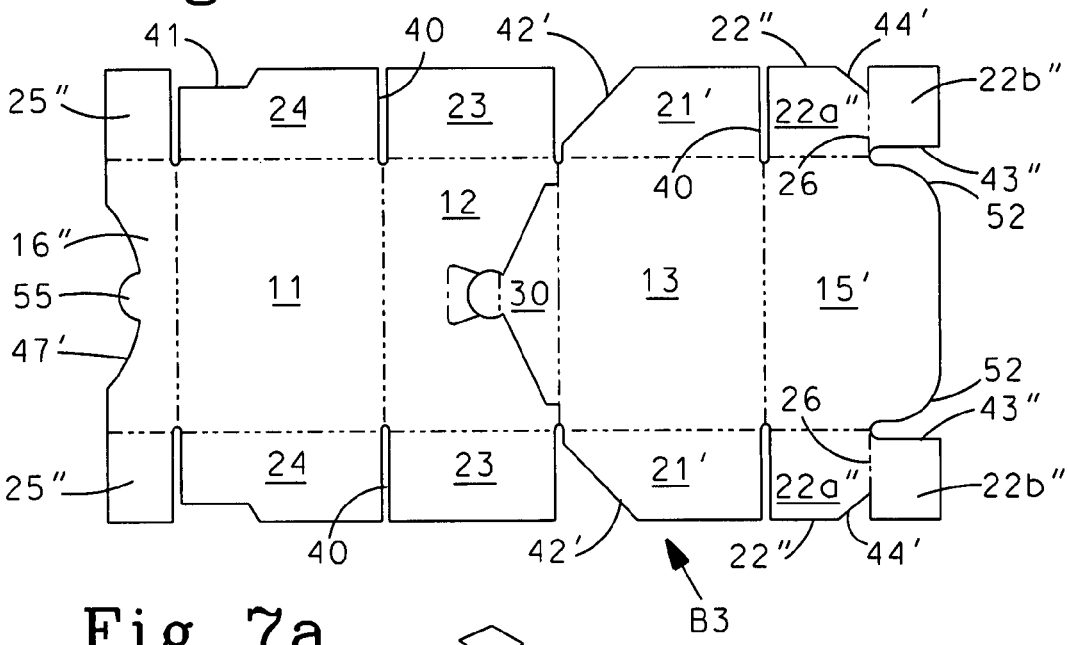
FIG. 7 is a top plan view of a blank for making a third embodiment of container according to the present invention, wherein the major front wall panel is also on the outside of the minor front wall panel.
Figure 7A:
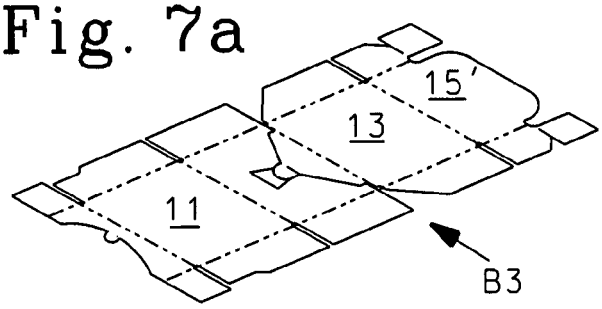
FIGS. 7*a*-7*i* are top perspective end views showing the steps in assembling and erecting the container of the invention according to the third embodiment.
Figure 7B:
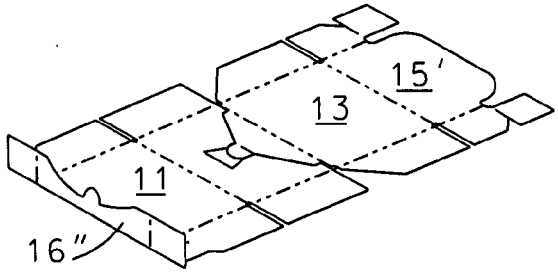
Figure 7C:
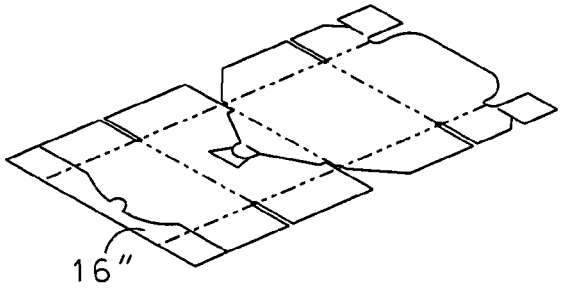
Figure 7D:
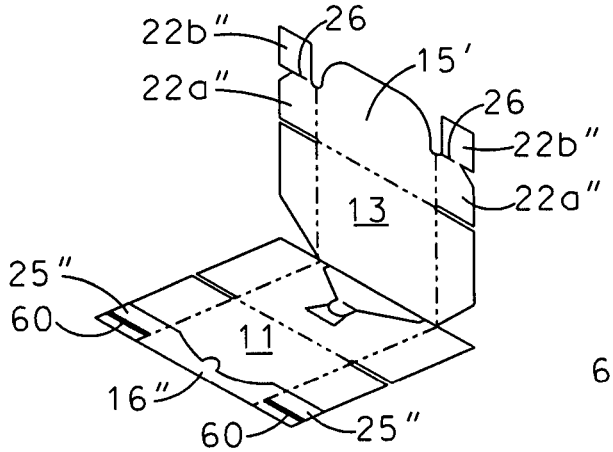
Figure 7E:
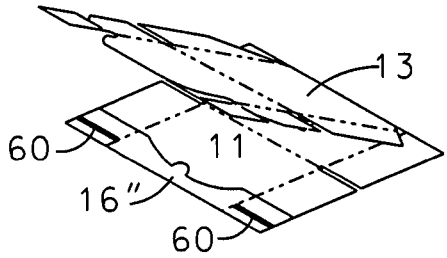
Figure 7F:
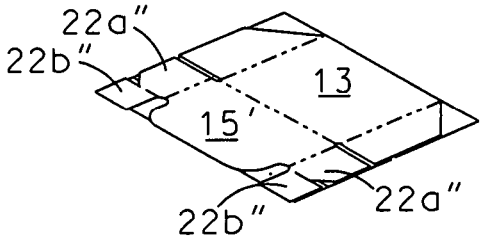
Figure 7G:
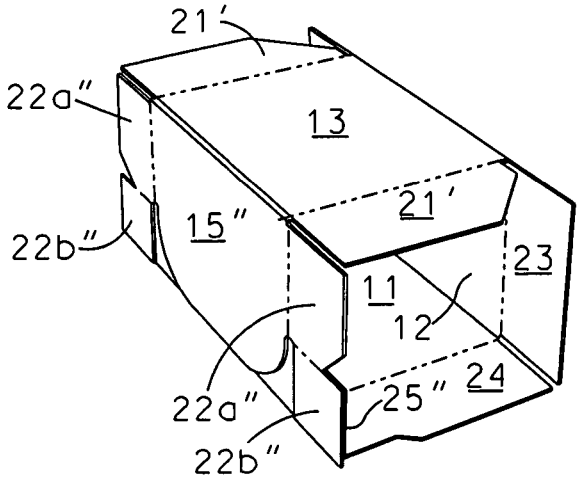
Figure 7H:
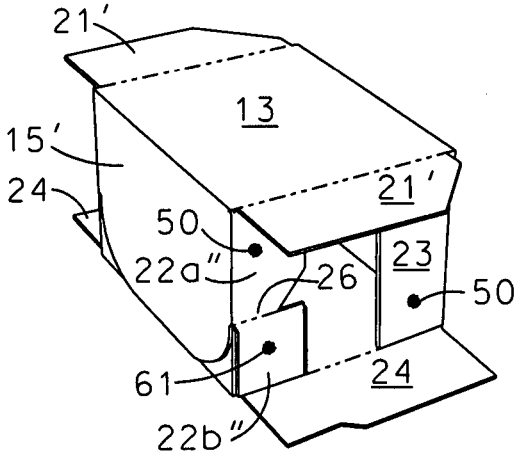
Figure 7I:
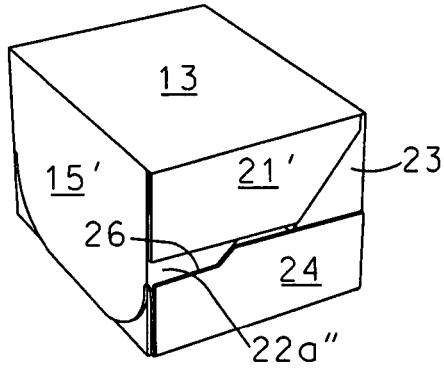
Figure 8:
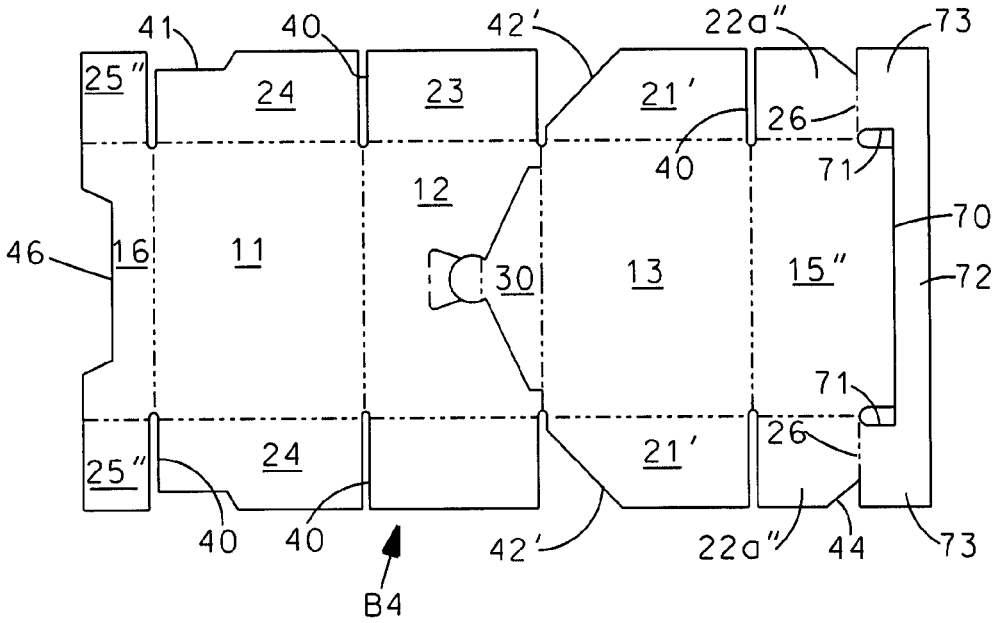
FIG. 8 is a top plan view of a blank for making a fourth embodiment of container according to the invention, wherein the major front wall panel is on the inside of the minor front wall panel.
Figure 8A:
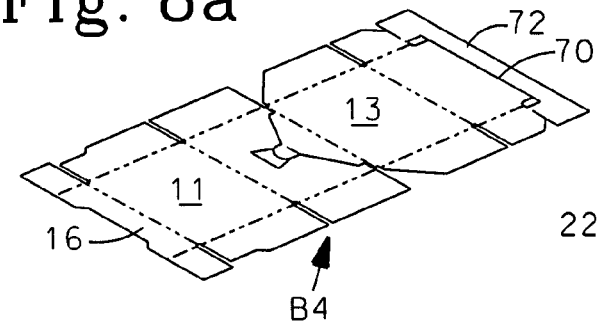
FIGS. 8*a*-8*i* are top perspective end views showing the steps of assembling and erecting the fourth embodiment of FIG. 8.

A blank B3 for making a third embodiment of container according to the invention is illustrated in FIG. 7. The bottom, back and top wall panels 11, 12 and 13, respectively, and their associated side flaps in this form of the invention are essentially the same as in the previous embodiments, except that the corner of the side flaps 21' extending from the top wall panel is cut off at an angle 42' rather than rounded as in the previous embodiments. The major differences in this embodiment are in the shapes of the major and minor front wall panels and the side flaps extending therefrom, and the way in which the blank is folded and glued. Thus, with reference to FIG. 7 and FIGS. 7*a*-7*i*, the cut-outs 43" produce rounded corners 52 on the free edge of the major front wall panel 15', and the second portions 22*b*" of the second flaps 22" are rectangular in shape, having nearly the same width as the first portions 22*a*". The V-shaped cuts 44' at the outer ends of the frangible lines 26 are also deeper than in the previous embodiments. The cut-outs 47' in the outer free edge of the minor front wall panels 16" also produce a rounded concave shape with a convex protrusion 55 in the center, and the side flaps 25" extending therefrom are rectangular in shape, with the same width as the minor front wall panel.

In assembling and erecting the blank B3, as seen in FIGS. 7*a*-7*i*, the minor front wall panel 16" is first folded inwardly into overlying relationship with the adjoining panel (FIGS. 5*b* and 5*c*). Lines of glue 60 are then applied to the side flaps 25" and the blank is folded about the fold line joining the back panel to the top panel (FIGS. 5*d*, 5*e* and 5*f*), adhering the second portions 22*b*" to the side flaps 25" to produce a flattened container ready for shipment to a point of use (FIG. 5*f*). The flattened container is set up into an erected container in the same way as in the previous embodiments (FIGS. 5*g*-5*i*), except that the second portion 22*b*" of the side flaps on the major front wall panel are adhesively secured to the side flaps 25" on the minor front wall panels, which panels are, in turn, adhesively secured to the side flaps 24 on the bottom panel. Thus, spots of adhesive 50 are applied to a lower end portion of side flap 23 and first side flap portion 22*a*" as in the previous embodiments, but since the second side flap portion 22*b*" overlies the side flap 25, a spot of adhesive 61 is applied to the outside of side flap portion 22*b*". In the previous embodiments the second portions 22*b* are adhesively secured directly to the side flaps 24.

A blank B4 for making a fourth embodiment of container according to the invention is illustrated in FIGS. 8 and 8*a*-8*j*. This form of the invention combines some features from the embodiments shown in FIGS. 5, 6 and 7, namely, it has the angled corner 42' on the side flaps extending from the top panel and rectangular side flaps 25" extending from the minor front wall panel as in the FIG. 7 embodiment, and the straight recessed edge portion 46 on the minor front wall panel as in the FIGS. 5 and 6 embodiments. It differs primarily in the structure and shape of the outer free edge of the major front wall panel 15", which in this embodiment has a transverse cut 70 extending the width of the panel in inwardly spaced relation to the outer free edge, and the cut terminates in cut-outs 71 extending from the terminal ends of the cut 70 to the inner end of the frangible lines 26, defining a tear-away flap 72 on the outer free edge of the major front wall panel. The opposite ends 73 of the flap are joined to the first portion 22*a*" of the side flaps on the major front wall panel, and replace or comprise the second portions 22*b* described in the previous embodiments.

Figure 8B:
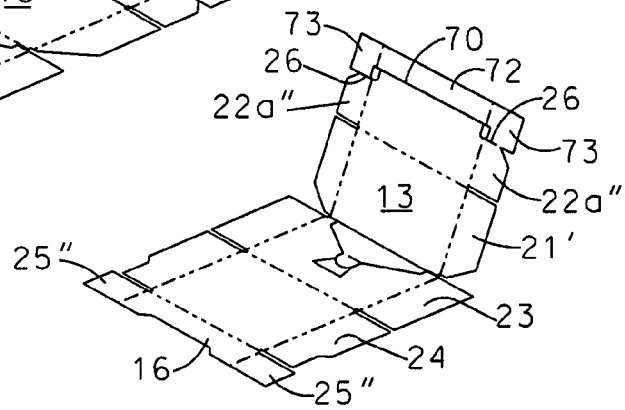
Figure 8C:
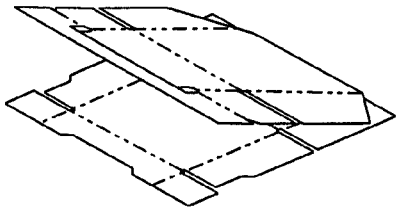
Figure 8D:
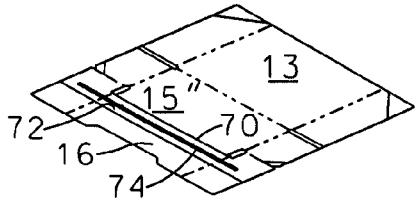
Figure 8E:
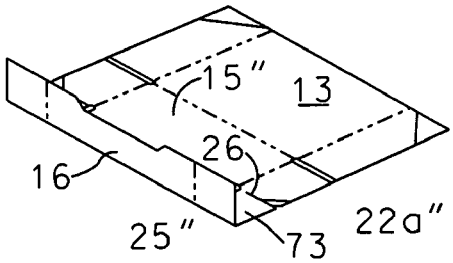
Figure 8F:
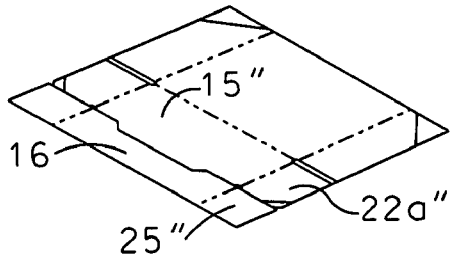
Figure 8G:
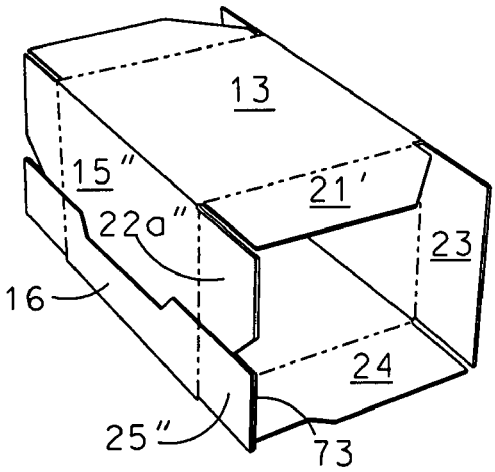
Figure 8H:
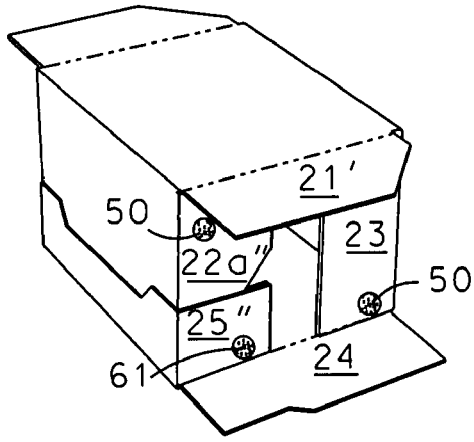
Figure 8I:
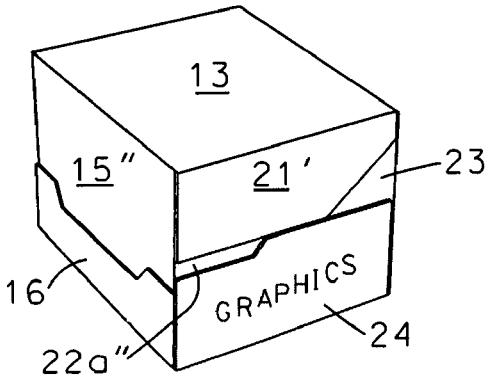
Figure 8J:
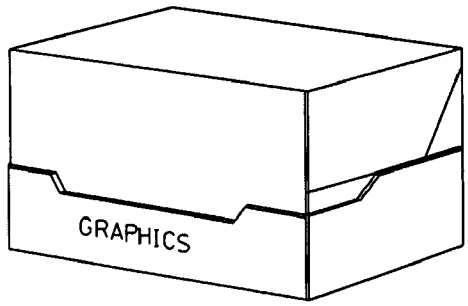
FIG. 8*j* is a top perspective front view of the erected container of FIGS. 8 and 8*a*-8*i*.

In assembling and erecting the blank B4, as seen in FIGS. 8*a*-8*i*, the blank is first folded about the fold line joining the top panel to the back panel (FIGS. 8*b* and 8*c*). A line of glue 73 is then applied along the tear-away flap 72 and into the ends 73 (FIG. 8*d*). The minor front wall panel is then folded over the adjacent edge of the major front wall panel and adhered to the tear-away flap and ends 73, forming a flattened container ready to be shipped to a user (FIG. 8*f*). As seen in FIGS. 8*g*-8*i*, the container is otherwise erected in generally the same way as the previous embodiments, and particularly that shown in FIGS. 7*a*-7*h*. In this form of the invention the major front wall panel is inside the minor front wall panel, leaving a smooth flat surface on the front and sides of the container for displaying graphics.

The various panels and flaps that are adhered together in the present invention may be secured to one another in any suitable known manner. In a presently preferred embodiment, glue is employed to hold the panels and flaps together. However, other securing means are considered within the scope of this invention, such as without limitation, staples, tape and any other type of adhesive. The method of securing the panels together is within the scope of those skilled in the art.

Any variety of additional elements may be included, such as, without limitation, vents, specialized liners or grease barriers, etc., without departing from the spirit and scope of the present invention. Similarly, rounding or otherwise trimming the various panels is considered within the scope of the instant invention.

While the preferred embodiment of the invention has been illustrated and described, many changes can be made without departing from the spirit and scope of the invention as defined by the appended claims.

What is claimed is:

1. An easy opening shipping and display container, comprising:

a bottom wall, a top wall, with first and second front wall panels, and a back wall, each having side flaps at opposite ends folded inwardly to define opposite side walls;

the first front wall panel comprises a major front wall panel having a height from its folded connection with the top wall panel that is substantially the same as the height of the back wall panel;

the second front wall panel comprises a minor front wall panel having a height substantially less than the height of the major front wall panel;

a first side flap portion of the side flaps extending from opposite ends of the major front wall panel is larger than a second side flap portion;

the side flaps extending from opposite ends of the minor front wall portion are shaped and sized generally complementary to the size and shape of the second side flap portions;

the first and second front wall panels each having a side flap extending into said side wall and being secured together by attachment of said side flaps with side flaps on the top and bottom walls, respectively;

first frangible means securing said top wall to said back wall, said first frangible means comprises a tear-out panel integral with the top wall and extending from a front edge of the top wall and into the back wall; and second frangible means securing said top wall to said side walls, whereby the first frangible means may be grasped and lifted to lift the top wall and break the second frangible means, completely freeing the top wall from the container by the single step of grasping and tearing out and lifting the first frangible means to pivot the top upwardly and wherein said second frangible means comprises a line of perforations connecting together the side flaps on the first and second front wall panels, wherein by grasping and tearing out the tear-out panel and lifting the tear-out panel to pivot the top upwardly, the lines of perforations in the side walls that connect the first and second front wall panels together are broken, thereby completely removing the top of the container in a single step and wherein the side flaps include first side flaps (21) extending from respective opposite ends of the top wall, second side flaps (22) extending from respective opposite ends of the major front wall panel, said second side flaps including first and second portions (22*a*, 22*b*) connected by said line of perforations, third side flaps extending from respective opposite ends of the back wall, fourth side flaps extending from respective opposite ends of the bottom wall, and fifth side flaps extending from respective opposite ends of the minor front wall panel;

said first side flaps (21) are folded and secured to a respective adjacent first portion (22*a*) of said second side flaps (22) and are unsecured to said third side flaps (23);

said first portions (22*a*) of said second side flaps (22) are folded and secured to respective said first side flaps (21), and said second portions (22*b*) of said second side flaps (22) lie behind and are connected to respective said fourth side flaps (24) wherein respective lengths and widths of said first portions (22*a*) and said second portions (22*b*) are less than the respective lengths and widths of second side flaps (22) and wherein the respective free edge of said first portions (22*a*) and said second portions (22*b*) includes a cut-outs to provide an alignment with the major front wall panel; and said fourth side flaps are folded and secured to said third side flaps and to said fifth side flaps.

2. A container as claimed in claim 1, wherein:

said second portions of said second side flaps are secured, respectively, directly to said fourth side flap.

3. A container as claimed in claim 1, wherein:

said second portions of said second side flaps lie behind and are secured to respective said fifth side flaps, which are, in turn, secured to respective said fourth side flaps.

4. A container as claimed in claim 1, wherein:

said tear-out panel is formed by a pair of diagonal weakened lines of perforations in said back wall, converging from adjacent opposite side edges of the top wall to about the center of said back wall, defining a generally triangularly shaped panel; and a thumb tab is connected to said tear-out panel where the weakened lines of perforations converge together, to facilitate grasping and removing the tear-out panel from the back wall.

5. A container as claimed in claim 1, wherein:

said tear-out panel is formed by a pair of diagonal weakened lines of perforations in said back wall, converging from adjacent opposite side edges of the top wall to about the center of said back wall, defining a generally triangularly shaped panel; and a thumb tab is connected to said tear-out panel where the weakened lines of perforations converge together, to facilitate grasping and removing the tear-out panel from the back wall.

6. A container as claimed in claim 5, wherein:

removal of said tear-out panel and breaking of said weakened lines of perforations connecting together said first and second portions of said second side flaps results in complete separation and removal from said container of said top wall, said first side flaps, said major front wall panel, and said first portions of said second side flaps, whereby a remaining container bottom portion has reduced height side walls, front wall and back wall.

7. A container as claimed in claim 1, wherein:

said first front wall panel comprises a major front wall panel, and the second front wall panel comprises a minor front wall panel, said major and minor front wall panels overlapping at adjacent edges.

8. A container as claimed in claim 7, wherein:

the major front wall panel lies outside said minor front wall panel at said overlapped edges.

9. A container as claimed in claim 7, wherein:

the major front wall panel lies behind said minor front wall panel at said overlapped edges.

* * * * *